United States Patent [19]

Byrd

[11] Patent Number: 4,582,216

[45] Date of Patent: Apr. 15, 1986

[54] EASY OPEN-RECLOSABLE CONTAINER WITH POURING LIP/DRAIN SURFACE

[75] Inventor: Alan E. Byrd, Hamilton, Ohio

[73] Assignee: The Procter & Gamble Company, Cincinnati, Ohio

[21] Appl. No.: 623,806

[22] Filed: Jun. 22, 1984

[51] Int. Cl.[4] ..... B65D 51/22

[52] U.S. Cl. ..... 220/260; 220/85 SP; 220/90.4; 220/259

[58] Field of Search ..... 220/335, 259, 269, 307, 220/339, 90.4, 85 SP, DIG. 5, 260

[56] References Cited

U.S. PATENT DOCUMENTS

| | | | |
|---|---|---|---|
| Re. 21,310 | 12/1939 | Mackey | 221/11 |
| 2,098,763 | 11/1937 | Sebell | 221/11 |
| 2,661,861 | 12/1953 | Oldenburg | 220/31 |
| 2,974,824 | 3/1961 | Mansho | 220/53 |
| 3,217,951 | 11/1965 | Paal | 222/528 |
| 3,281,024 | 10/1966 | Henchert et al. | 222/484 |
| 3,300,106 | 1/1967 | Chmela | 222/517 |
| 3,302,818 | 2/1967 | Balocca et al. | 220/53 |
| 3,323,671 | 6/1967 | Minarik, Jr. et al. | 215/40 |
| 3,419,198 | 12/1968 | Pettersen | 222/541 |
| 3,424,338 | 1/1969 | Kazel | 220/54 |
| 3,441,167 | 4/1969 | Balocca | 220/53 |
| 3,473,705 | 10/1969 | May et al. | 222/541 |
| 3,913,782 | 10/1975 | Cass | 220/260 |
| 3,938,693 | 2/1976 | Patel et al. | 220/267 |
| 3,980,213 | 9/1976 | Ramsey | 220/85 SP X |
| 3,990,603 | 11/1976 | Brochman | 220/260 |
| 4,029,033 | 6/1977 | Kerwin et al. | 113/121 |
| 4,054,205 | 10/1977 | Blow, Jr. et al. | 220/85 SP X |
| 4,090,660 | 5/1978 | Schram et al. | 229/43 |
| 4,108,330 | 8/1978 | Patterson | 220/260 |
| 4,164,303 | 8/1979 | Waterbury | 220/359 |
| 4,189,060 | 2/1980 | Trotman, III | 220/260 |
| 4,232,797 | 11/1980 | Waterbury | 220/359 |
| 4,243,156 | 1/1981 | Lobbestael | 220/90.4 X |
| 4,358,032 | 11/1982 | Libit | 222/498 |
| 4,407,424 | 10/1983 | Heyn | 220/269 |
| 4,473,168 | 9/1984 | Cox | 220/259 X |
| 4,480,763 | 11/1984 | Schneider | 220/269 |

*Primary Examiner*—Steven M. Pollard

*Attorney, Agent, or Firm*—John J. Ryberg; E. Kelly Linman; John V. Gorman

[57] ABSTRACT

A container having an upstanding rim running around the periphery of its top lid and a pre-cut dispensing aperture therein is provided with an integral pouring lip/drain surface between the container's rim and dispensing aperture. The container is also provided with an easy-open/reclosing element that is preferably hingedly attached to the container's top lid. The easy-open/reclosing element has a depending plug that is shaped complementary to the dispensing aperture. When pressed into the aperture, the plug initially seals the container and, if desired, is used to reclose the aperture after opening. In a particularly preferred embodiment, the easy-open/reclosing element is provided with a U-shaped flange that is shaped complementary to both the top lid's pouring lip and upstanding rim. When the easy-open/reclosing element is in its closed position, this U-shaped flange receives the container's pouring lip and rim and thereby protects them from dirt and dust contamination. This sanitary feature is particularly appealing if a consumer desires to drink product directly from the container.

17 Claims, 7 Drawing Figures

EASY OPEN-RECLOSABLE CONTAINER WITH POURING LIP/DRAIN SURFACE

TECHNICAL FIELD

The present invention pertains to easy-open/reclosable containers, and more particularly to an easy-open/-reclosable rimmed container having a pouring lip/drain surface that is integrally formed within the container's top lid between a pre-cut dispensing aperture and the container'upstanding rim. Alternatively, the present invention is a separate reclosing/pouring lip device that may be readily attached to the container's top lid after the initial opening thereof.

BACKGROUND OF THE INVENTION

Easy-open containers are in wide use today in the beverage industry. Typically, these containers are opened by either removing a pull tab has been scored in the container's lid or by removing a pressure sensitive adhesive tape that covers a pre-cut dispensing aperture. An example of the latter type of opening means is disclosed in U.S. Pat. No. 3,389,827. These types of easy-open beverage containers are generally acceptable to consumers if the container's contents are entirely consumed or dispensed at the same time. However, if the user desires to only partially consume the contents and store the remainder, these containers are objectionable because they cannot be reclosed to keep the contents fresh or to keep foreign matter such as dust and dirt from entering the opened container. Furthermore, if the beverage contains suspended solids such as fruit pulp, the container cannot be reclosed and shaken to redistribute such solids.

Recently, there have been several attempts to provide an easy-open beverage container with reclosing means. One such attempt is generally shown in U.S. Pat. Nos. 4,164,303 and 4,232,797, both to Waterbury. Waterbury discloses several embodiments of an articulated closure element that is attached to a container having an upstanding rim about the periphery of the container's top lid. The closure element is hingedly mounted on the container's top lid adjacent to a pre-cut dispensing aperture and has a depending plug or bead on its undersurface that is shaped complementary to the aperture. After initial opening, the container can be reclosed by returning the closure element to its original position such that the depending plug or bead tightly engages the dispensing aperture.

Although Waterbury's articulated closure element does allow a rimmed container to be reclosed after initial opening, consumers nevertheless find this general type of container to be objectionable for the following reasons. First, when such a container is returned to its upright position after a portion of the beverage has been dispensed, a residual amount of beverage is inevitably trapped between the dispensing aperture and the container's upstanding rim. Thereafter, this residual tends to spread out over the container's lid and, during storage, starts to collect dirt and dust. Furthermore, if the beverage is sweet such as fruit juice, the residual attracts insects. Second, the closure element does not prevent dirt and dust from contaminating the container's lid and rim in the area where a consumer's lips come into contact if the consumer drinks directly from the container. Finally, the friction fit between the closure's depending plug or bead and the aperture, which is the means for holding the closure element in its closed position, does not adequately prevent the closure element from popping out if the container is accidentally knocked over onto its side.

In light of the above, it is a principal object of the present invention to provide a rimmed container with an easy-open feature that can be used to reclose the container for subsequent storage of any remaining beverage and, if applicable, will allow the container to be shaken in order to redistribute solids such as fruit pulp.

Another principal object of the present invention is to provide a rimmed container with a pouring lip/drain surface that channels the container's contents up and over the container's rim when the container is tipped for dispensing purposes, and also channels any residual product remaining on the pouring lip/drain surface back into the container via the dispensing aperture when the container is returned to its upright position.

A further object of the present invention is to provide a rimmed container with a closure element that not only tightly closes the container's dispensing aperture, but also protects the container's lip-contacting surfaces, i.e. those surfaces that come into contact with a consumer's lips if the consumer drinks directly from the container, from dirt and other contaminants.

Another object of the present invention is to tightly secure a closure element in its reclosed position so that it will not readily pop out of the dispensing aperture and allow product to escape if the container is accidentally tipped over onto its side or gently shaken to redistribute solid particles such as fruit pulp.

SUMMARY OF THE INVENTION

As used in the following summary and detailed description of the present invention, the term "initial seal" or variations thereof is intended to mean an air-tight, hermetic seal. When the term "seal" or "reseal" is used in describing the container after the initial opening thereof, it is intended to mean a liquid leak-resistant seal rather than an air-tight, hermetic seal. In addition, the following summary and detailed description are generally directed to a beverage container. However, it will be readily apparent to those skilled in the art that the present invention can be practiced with equal facility in packaging a wide variety of products, for example soaps, chemicals, motor oils, powders, granules, and the like.

In a particularly preferred embodiment of the present invention, a container having an upstanding rim running around the periphery of its top lid and a pre-cut dispensing aperture in the lid is provided with an integral pouring lip/drain surface between the rim and the dispensing aperture. When the container is tipped for dispensing purposes, the integral pouring lip/drain surface channels the product up and over the upstanding rim. When the container is returned to its upright position, the pouring lip/drain surface channels any residual product remaining between the aperture and rim back into the container rather than allowing it to spread out over the lid.

In this particularly preferred embodiment, the container is also provided with an easy-open/reclosing element that is hingedly attached to the lid's outer surface. The easy-open/reclosing element has a depending plug on its bottom surface that is shaped complementary to the dispensing aperture. This depending plug is used to seal the container's dispensing aperture before initial opening and, when returned to its original position, after a portion of the container's contents have been dispensed.

In the particularly preferred embodiment, the easy-open/reclosing element is also provided with an integral U-shaped flange that is shaped complementary to the container's upstanding rim and pouring lip. This U-shaped flange gives the container two attractive features. First, when the reclosing element is in its closed position, the U-shaped flange receives the container's rim and pouring lip and protects them against dust and dirt contamination. This feature is particularly appealing if the consumer desires to drink directly from the container. Second, the friction fit between the reclosing element's U-shaped flange and the container's rim helps keep the reclosing element secured in its reclosed position during storage.

In the particularly preferred embodiment, the easy-open/reclosing element is further provided with a grasping tab that facilitates easy opening by the consumer. The grasping tab is attached to the easy-open/reclosing element along a frangible line that breaks when the grasping tab is lifted from the container's top lid to initially open the container.

In another preferred embodiment, a container having an upstanding rim running around the periphery of its top lid and a pre-cut dispensing aperture in the lid is provided with an attachable closure/pouring lip device. The container's pre-cut dispensing aperture is initially sealed with, for example, a thermosealed tape. Once the tape is removed, the device is snapped in place on the container's top lid for dispensing and reclosing purposes.

The attachable closure/pouring device consists of a base portion having a pre-cut aperture that is shaped complementary to the pre-cut aperture in the container's lid. The base portion's bottom surface has a small bead that encircles the aperture therein. When the closure/pouring device is attached to the container's top lid, this bead sealingly snap fits into the lid aperture and holds the closure/pouring device in place. The base portion also has a U-shaped flange at one end that is shaped complementary to the container's upstanding rim. When the reclosing/pouring device is properly placed on the container's lid, the friction fit between the container's rim and the U-shaped flange further helps in securing the device to the top lid.

The attachable closure/pouring device also has a pouring lip/drain surface between the base portion's dispensing aperture and U-shaped flange. When the container is tipped for dispensing purposes after the device has been properly secured on the container's top lid, this pouring lip/drain surface channels the container's contents up and over the container's rim. Similarly, when the container is returned to its upright position, the pouring lip/drain surface channels any residual product remaining on the pouring lip/drain surface back into the container.

The attachable closure/pouring lip device is further provided with a closure element that is preferably hingedly attached to the base portion. This closure element has a depending plug on its bottom surface that is shaped complementary to both the aperture in the base portion and the aperture in the container's lid. When it is desired to reclose the container, the closure element is pushed down such that the depending plug snugly enters the aperture in the device's base portion and the aperture in the container's lid.

In a particularly preferred embodiment of the reclosing/pouring device, the closure element is further provided with a U-shaped flange that is shaped complementary to both the base portion's U-shaped flange and pouring lip/drain surface. When the closure element is pressed down into its closed position, the base portion's U-shaped flange is received by the closure element's U-shaped flange in a friction fit arrangement and thereby contributes in keeping the closure element in its closed position. The closure element's U-shaped flange also serves the important function of protecting the base portion's U-shaped flange and pouring lip area against dirt, dust, and other contaminant accumulation.

BRIEF DESCRIPTION OF THE DRAWINGS

While the specification concludes with claims that particulaly point out and distinctly claim the present invention, it is believed that the present invention will be better understood by reading the following description with references made to the following drawings in which:

DETAILED DESCRIPTION OF THE INVENTION

Figure 1:
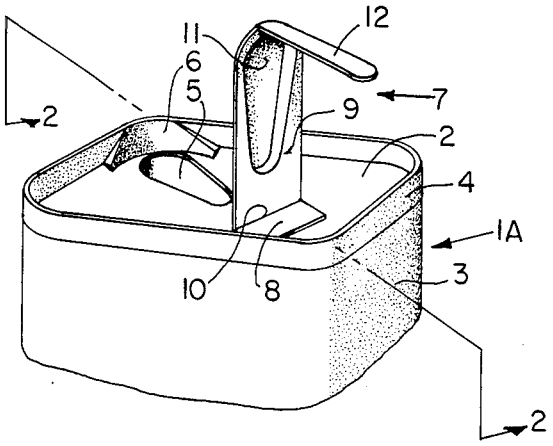
FIG. 1 is a perspective view of the top portion of a preferred container shown in its open position.

FIG. 1 shows the top portion of a rimmed container, generally denoted as 1A, after it has been initially opened. In FIG. 1, top lid 2 is attached to container body portion 3 by any of several operations known to those skilled in the art of container manufacturing. Illustrative of such operations are single seaming and double seaming. Alternatively, top lid 2 and body portion 3 can be integrally formed together as would be the case if the container was molded from a thermoplastic material. Regardless of the type of manufacturing operation used, the container of the present invention has an upstanding rim 4 running around the periphery of top lid 2. Body portion 3 can be made from a wide variety of materials such as aluminum, fiberboard, plastic, or a combination thereof. Similarly, top lid 2 can also be made from a wide variety of materials such as thermoformed PVC, aluminum, or a laminate comprised of PVC, aluminum foil, and polyethylene.

As seen in FIG. 1, top lid 2 has a pre-cut dispensing aperture 5 that is generally located between the center of the lid and upstanding rim 4. The aperture shown in FIG. 1 is tear-shaped but may take on other shapes such as oval or circular. Integrally formed within top lid 2 between dispensing aperture 5 and upstanding rim 4 is a pouring lip/drain surface 6. When the user of the present invention tips the container to dispense a portion of the container's contents into, for example, a cup or glass, pouring lip 6 channels the beverage up and over the container's upstanding rim 4 rather than allowing a portion of the beverage to be trapped between rim 4 and aperture 5. When the container is thereafter returned to its upright position, any residual product remaining on pouring lip/drain surface 6 is channeled back inside the container via dispensing aperture 5 rather than spreading out over the surface of top lid 2, as would be the undesirable situation if pouring lip/drain surface 6 were not present.

Still referring to FIG. 1, a closure element generally denoted as 7 is provided as the means for both initially sealing the container and subsequently reclosing the container after it has been initially opened. A particularly suitable material for making closure element 7 is thermoformed K-Resin ®, which is available from the Phillips Chemical Company of Pasadena, Tex. Also suitable is a multilayer film comprised of polysytrene, PVDC, and polyethylene, which is available from Continental Can Company, Stamford, Conn., and designated as Cobelplast A.95. Closure element 7 comprises a fixed portion 8 and a movable portion 9 with hinge 10 separating the two. Fixed portion 8 is securely attached to top lid 2 adjacent to dispensing aperture 5 which, depending on the materials used, can be accomplished by a heatsealing, adhesive bonding, or solvent bonding process. As used in the art, "heat sealing" means applying heat and pressure to two separate pieces that are coated with a low melt polymer; "adhesive bonding" means using a heated glue or adhesive, which is typically a polymer such as EVA or LDPE with a wax additive; "solvent bonding" typically involves the surface "melting" of two polymeric pieces by applying a solvent followed by heat which drives off the solvent and leaves the two pieces fused together. Alternatively, fixed portion 8 and hinge 10 can be eliminated thereby making movable portion 9 completely removable from top lid 2. However, this alternative is generally less desirable than the hingedly attached version shown in FIGS. 1 and 2 because a fully removable closure element 7 could be easily lost, misplaced, or misaligned.

Figure 2:
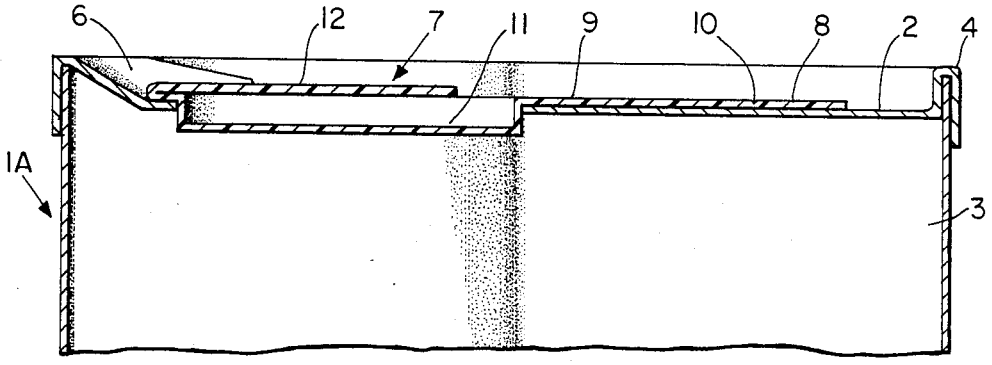
FIG. 2 is an enlarged cross-sectional view of the container shown in FIG. 1 taken at a point corresponding to section line 2—2, but shown with the closure element in its closed position.

Still referring to FIG. 1, movable portion 9 of closure element 7 has a depressed plug portion 11 that is shaped complementary to dispensing aperture 5. Preferably, plug 11 is just slightly larger in size than aperture 5 so that there is a tight friction fit between the two when movable portion 9 is in its closed position as shown in FIG. 2. This tight friction fit provides a seal sufficient to allow a consumer to shake the container to redistribute solids such as fruit pulp. In a preferred embodiment, a grasping tab 12 is hingedly attached to movable portion 9 to facilitate easy grasping of movable portion 9 by the user.

Figure 3:
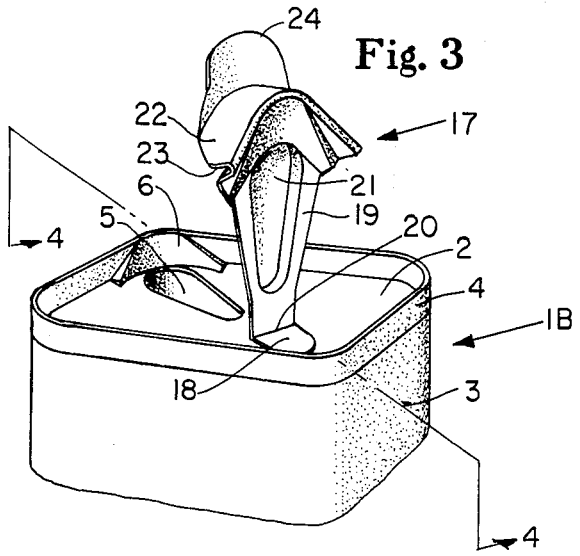
FIG. 3 is a perspective view of another preferred container shown in its open position.
Figure 4:
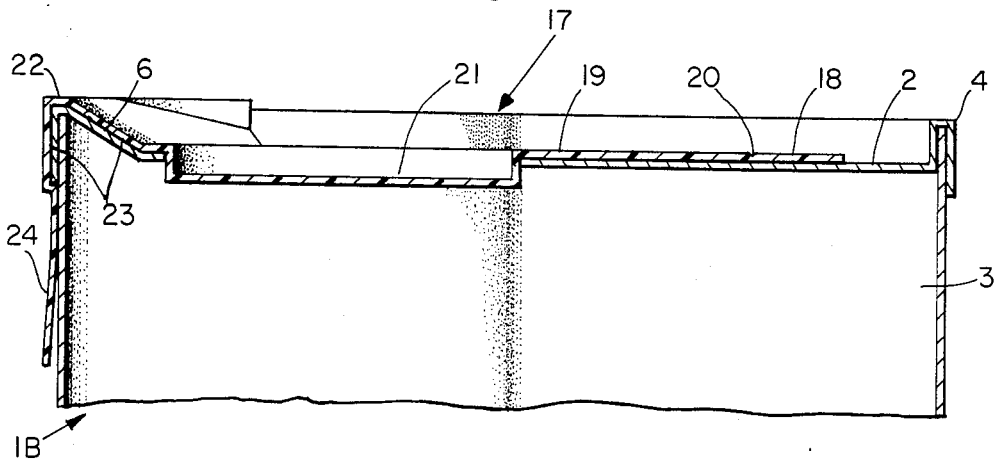
FIG. 4 is an enlarged cross-sectional view of the container shown in FIG. 3 taken at a point corresponding to section line 4—4, but shown with the closure element in its closed position.

FIGS. 3 and 4 illustrate a particularly preferred embodiment of the present invention that is similar to the one shown in FIGS. 1 and 2, but with the addition of several attractive features. In FIG. 3, the top portion of a container generally indicated as 1B has a top lid 2, a container body portion 3, an upstanding peripheral rim 4, a pre-cut dispensing aperture 5, and a pouring lip/drain surface 6 that is integrally formed within top lid 2 between aperture 5 and upstanding rim 4. Pouring lip/drain surface 6 again serves the important function of channeling product up and over rim 4 when the container is tipped for dispensing purposes and channeling product back into the container when the container is returned to its upright position.

As seen in FIG. 3, a closure element generally indicated as 17, which has a fixed portion 18, movable portion 19, and hinge 20, is hingedly attached to top lid 2 adjacent to dispensing aperture 5. A depending plug 21, which is shaped complementary to aperture 5, is located on the underside of movable portion 19. When closure element 17 is returned to its closed position as shown in FIG. 4, depending plug 21 enters aperture 5 and seals the container thereby allowing a consumer to shake the container if desired.

Still referring to FIG. 3, a U-shaped flange 22 is formed at the outermost area of movable portion 19. The inner surface 23 of U-shaped flange 22 is shaped complementary to upstanding rim 4 and pouring lip/drain surface 6. When closure element 17 is in its closed position as shown in FIG. 4, U-shaped flange 22 receives both upstanding rim 4 and pouring lip 6. This attractive feature protects rim 4 and lip 6 from dirt and dust contamination during storage and is particularly attractive if a consumer desires to drink directly from the container. Movable portion 19 is also provided with a flexible tab 24 to facilitate the easy grasping and lifting up of movable portion 19 to open the container. As seen in FIG. 4, tab 24 initially hugs the body portion 2 to facilitate the orderly nesting of several containers inside a shipping carton.

Figure 5:
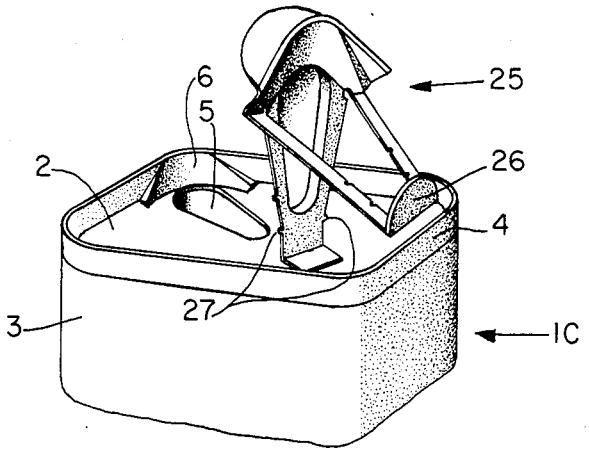
FIG. 5 is a perspective view of the top portion of the container of the type shown in FIG. 3 with the addition of a convenient grasping tab.
Figure 6:
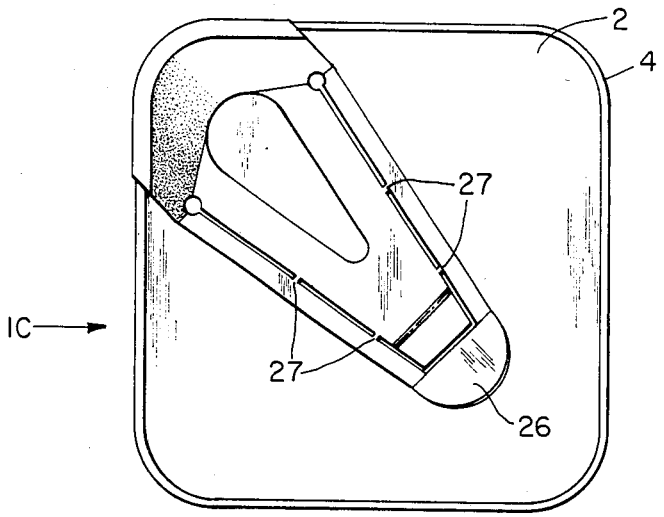
FIG. 6 is an enlarged plan view of the container shown in FIG. 5.

FIGS. 5 and 6 illustrate another particularly preferred embodiment of the present invention that is similar to the embodiment shown in FIG. 3. In FIGS. 5 and 6, the top portion of a container generally indicated as 1C has a top lid 2, a container body portion 3, an upstanding peripheral rim 4, a pre-cut dispensing aperture 5, and a pouring lip/drain surface 6 that is integrally formed within top lid 2 between aperture 5 and upstanding rim 4. Container 1C also has a closure element generally indicated as 25 that is hingedly attached to top lid 2. Closure element 25 is basically the same as closure element 17 shown in FIGS. 3 and 4 with the addition of grasping tab 26 that is frangibly attached to closure element 25 by a series of frangible links 27. As seen in FIG. 6, grasping tab 26 initially lays flat on the surface of top lid 2 and does not project outward from the container and create a nesting problem. When tab 26 is lifted up from the surface of top lid 2, the tab separates, i.e., breaks free from closure element 25 along frangible links 27, as shown in FIG. 5, thereby providing a convenient means for a consumer to grasp closure element 25 to open the container.

Figure 7:
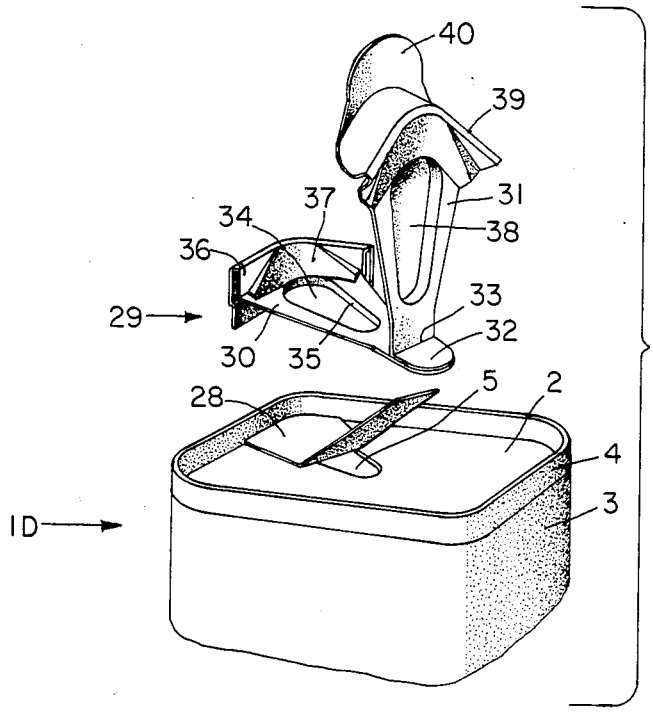
FIG. 7 is a perspective view of the top portion of a container and an attachable closure/pouring lip device of the present invention.

FIG. 7 shows an alternative embodiment of the present invention in the form of a pouring/reclosing device that is attachable to a container's top lid after the container has been initially opened. FIG. 7 shows the top portion of a container generally denoted as 1D that has a top lid 2, a body portion 3, and an upstanding rim 4. Top lid 2 has a pre-cut dispensing aperture 5 that is initially sealed with, for example, a fully removable adhesive tape tab 28 (shown in the process of being removed by a consumer). An example of such a tape tab is shown in U.S. Pat. No. 3,312,368, which is hereby incorporated by reference. A pouring/reclosure device generally denoted as 29 is shown just before it is attached to the top lid 2 of container 1D. Pouring/reclosure device 29 can either be sold separate from the container or can be included with the container and loosely attached thereto by, for example, enclosing container 10 and device 29 within a heat-shrinkable plastic wrapper.

Pouring/reclosing device 29 generally comprises a base portion 30, a movable portion 31, a fixed portion 32, and a hinge 32 between movable portion 31 and fixed portion 32. As seen in FIG. 7, fixed portion 32 is attached to base portion 30. Alternatively, fixed portion 32 and hinge 33 can be eliminated thereby making movable portion 31 separable from base portion 30. However, the hingedly attached version is preferred to avoid losing, misplacing, or misaligning movable portion 31.

Still referring to FIG. 7, base portion 30 has a dispensing aperture 34 that is shaped complementary to dispensing aperture 5 in the container's top lid 2. A bead 35 is located on the undersurface of base portion 30 and runs around the periphery of dispensing aperture 34. When base portion 30 of pouring/reclosing device 29 is properly attached to top lid 2, bead 35 snugly snaps into dispensing aperture 5 and firmly holds base portion 30 in place. Base portion 30 also has a downwardly projecting U-shaped flange 36 that is shaped complementary to the container's upstanding rim 4. When pouring/reclosing device 29 is properly attached to lid 2, U-shaped flange 36 snugly receives rim 4 and helps in firmly securing base portion 30 to top lid 2.

A pouring lip/drain surface 37 is integrally formed in base portion 30 between dispensing aperture 34 and U-shaped flange 36. When pouring/reclosing device 29 is attached to top lid 2 and container 1D is tipped to dispense the product therein, pouring lip 37 channels the product up and over U-shaped flange 36. Similarly, when container 1D is returned to its upright position, pouring lip 37 channels any residual product remaining thereon back into container 1D via dispensing apertures 34 and 5 rather than allowing the residual product to spread out over top lid 2.

A depending plug 38 is located on the undersurface of movable portion 31 and is shaped complementary to both dispensing apertures 5 (in top lid 2) and 34 (in base portion 30). After container 1D has been initially opened by removing tape 28 and pouring/reclosing device 29 has been properly attached to top lid 2, the container can be reclosed by bringing movable portion 31 down into contact with base portion 30 such that depending plug 38 sealingly enters both apertures 5 and 34.

In the preferred embodiment shown in FIG. 7, movable portion 31 has a U-shaped flange 39 that is shaped complementary to U-shaped flange 36 and pouring lip/drain surface 37. When movable portion 31 is in its closed position, U-shaped flange 39 snugly receives U-shaped flange 36 and pouring lip 37 and protects these critical areas from becoming contaminated by dust and dirt. In addition, the friction fit between complementary U-shaped flanges 36 and 39 helps in securing movable portion 31 in its closed position. Movable portion 31 can also be provided with a flexible grasping tab 40 to facilitate easy-opening by a consumer.

While several particularly preferred embodiments of the present invention have been described and illustrated, it will be obvious to those skilled in the art that various changes and modifications can be made without departing from the spirit and scope of the invention. Furthermore, while the preceding description of the present invention was generally directed to a beverage, the present invention can be applied with equal facility to any type of product that is poured from a container. Accordingly, the following claims are intended to embrace such changes, modifications, and applications that are within the scope of this invention.

What is claimed is:

1. An easy-open, reclosable container comprising:

(a) a hollow body portion having an uppermost and lowermost edge, said lowermost edge having a bottom end panel attached thereto;

(b) a top lid attached to said uppermost edge of said body portion, said top lid having a discrete dispensing aperture therein and an upwardly-projecting, peripheral rim;

(c) a pouring lip/drain surface integrally formed within said top lid between said dispensing aperture and said peripheral rim, said pouring lip/drain surface beginning at a point adjacent to said dispensing aperture and terminating in contacting relation with said peripheral rim;

(d) a closure element having a downwardly projecting plug that is shaped complementary said dispensing aperture whereby said aperture will readily receive said plug; and (e) means for releasably securing said plug within said dispensing aperture.

2. The container as recited in claim 1 wherein said means for releasably securing said plug within said dispensing aperture comprises a friction fit between said plug and said dispensing aperture.

3. The container as recited in claim 1 wherein said closure element has a grasping tab attached thereto.

4. An easy-open, reclosable container comprising:

(a) a hollow body portion having an uppermost and lowermost edge, said lowermost edge having a bottom end panel attached thereto;

(b) a top lid attached to said uppermost edge of said body portion, said top lid having a discrete dispensing aperture therein and an upwardly-projecting, peripheral rim;

(c) a pouring lip/drain surface integrally formed within said top lid between said dispensing aperture and said peripheral rim;

(d) a closure element having a downwardly projecting plug that is shaped complementary to said dispensing aperture whereby said aperture will readily receive said plug, said closure element further having a downwardly-projecting, U-shaped flange that is shaped complementary to said upwardly-projecting peripheral rim and said pouring lip/drain surface, whereby said U-shaped flange receives said rim and said pouring lip/drain surface when said closure element is in its closed position; and (e) means for releasably securing said plug within said dispensing aperture.

5. The container as recited in claim 4 wherein said means for releasably securing said plug within said dispensing aperture comprises a friction fit between said downwardly-projecting U-shaped flange and said upwardly-projecting peripheral rim.

6. The container as recited in claim 4 wherein said downwardly-projecting U-shaped flange has a grasping tab attached thereto.

7. An easy-open, reclosable container comprising:

(a) a hollow body portion having an uppermost and lowermost edge, said lowermost edge having a bottom end panel attached thereto;

(b) a top lid attached to said uppermost edge of said body portion, said top lid having a discrete dispensing aperture therein and an upwardly-projecting, peripheral rim;

(c) a pouring lip/drain surface integrally formed within said top lid between said dispensing aperture and said peripheral rim, said pouring lip/drain surface beginning at a point adjacent to said dispensing aperture and terminating in contacting relation with said peripheral rim;

(d) a closure element having a moveable portion; a fixed portion, and a hinge, said moveable portion having a downwardly-projecting plug that is shaped complementary to said dispensing aperture whereby said aperture will readily receive said plug, said fixed portion being attached to said top lid adjacent to said dispensing aperture; and (e) means for releasably securing said plug within said dispensing aperture.

8. The container as recited in claim 7 wherein said means for releasably securing said plug within said dispensing aperture comprises a friction fit between said plug and said dispensing aperture.

9. The container as recited in claim 7 wherein said moveable portion of said closure element has a grasping tab attached thereto.

10. An easy-open, reclosable container comprising:

(a) a hollow body portion having an uppermost and lowermost edge, said lowermost edge having a bottom end panel attached thereto;

(b) a top lid attached to said uppermost edge of said body portion, said top lid having a discrete dispensing aperture therein and an upwardly-projecting, peripheral rim;

(c) a pouring lip/drain surface integrally formed within said top lid between said dispensing aperture and said peripheral rim;

(d) a closure element having a movable portion, a fixed portion, and a hinge, said movable portion having downwardly-projecting plug that is shaped compelementary to said dispensing aperture whereby said aperture will readily receive said plug, said fixed portion being attached to said top lid adjacent to said dispensing aperture, said movable portion of said closure element having a downwardly-projecting U-shaped flange that is shaped complementary to said upwardly-projecting peripheral rim and said pouring lip/drain surface, whereby said U-shaped flange receives said rim and said pouring lip/drain surface when said movable portion is in its closed position; and (e) means for releasably securing said plug within said dispensing aperture.

11. The container as recited in claim 10 wherein said means for releasably securing said plug within said dispensing aperture comprises a friction fit between said downwardly-projecting U-shaped flange and said upwardly-projecting peripheral rim.

12. The container as recited in claim 10 wherein said U-shaped flange has a grasping tab attached thereto.

13. A dispensing/reclosing device for use on a container, said container having a peripheral rim projecting upwardly from the top lid of said container, said top lid having a first dispensing aperture therein, said device comprising:

(a) a base portion having a top and bottom surface and a second dispensing aperture that corresponds both in size and shape to said first dispensing aperture, said base portion further having a first U-shaped flange that is shaped complementary to said upwardly-projecting peripheral rim whereby said first U-shaped flange will readily receive said rim when said device is applied to said top lid of said container, said bottom surface of said base portion having a downwardly-projecting bead that enters and snugly engages said first dispensing aperture in said top lid when said device is applied to said top lid;

(b) a pouring lip/drain surface integrally formed within said base portion between said second aperture and said first U-shaped flange, said pouring lip/drain surface beginning at a point adjacent to said second aperture and terminating in contacting relation with said first U-shaped flange;

(c) a closure element having a downwardly-projecting plug that is shaped complementary to both first and second dispensing apertures whereby said apertures will readily receive said plug when said device is attached to said top lid of said container and said closure element is in its closed position; and (d) means for releasably securing said plug within said first and second dispensing apertures.

14. The dispensing/reclosing device as recited in claim 13 wherein said means for releasably securing said plug within said first and second dispensing apertures comprises a friction fit between said plug and said first and second apertures.

15. The dispensing/reclosing device as recited in claim 13 wherein said closure element is hingedly attached to said top surface of said base portion.

16. A dispensing/reclosing device for use on a container, said container having a peripheral rim projecting upwardly from the top lid of said container, said top lid having a first dispensing aperture therein, said device comprising:

(a) a base portion having a top and bottom surface and a second dispensing aperture that corresponds both in size and shape to said first dispensing aperture, said base portion further having a first U-shaped flange that is shaped complementary to said upwardly-projecting peripheral rim whereby said first U-shaped flange will readily receive said rim when said device is applied to said top lid of said container;

(b) a pouring lip/drain surface integrally formed within said base portion between said second aperture and said frst U-shaped flange;

(c) a closure element having a downwardly-projecting plug that is shaped complementary to both first and second dispensing apertures whereby said apertures will readily receive said plug when said device is attached to said top lid of said container and said closure element is in its closed position, said closure element further having a second U-shaped flange that is shaped complementary to said first U-shaped flange and said pouring lip/drain surface of said portion, whereby said second U-shaped flange will readily receive said first U-shaped flange and said pouring lip/drain surface when said device is attached to said top lid of said container and said closure element is in its closed position; and (d) means for securing said device to said top lid of said container, whereby said second aperture of said base portion coincides with said first dispensing aperture of said top lid.

17. The dispensing/reclosing device as recited in claim 16 wherein said closure element is hingedly attached to said top surface of said base portion.

* * * * *

UNITED STATES PATENT AND TRADEMARK OFFICE

CERTIFICATE OF CORRECTION

PATENT NO. : 4,582,216

DATED : April 15, 1986

INVENTOR(S) : Alan E. Byrd

It is certified that error appears in the above-identified patent and that said Letters Patent is hereby corrected as shown below:

Column 1, line 19, after "tab" insert -- that --.

Column 4, line 17, "particulaly" should read -- particularly --.

Column 5, line 21, "polysytrene" should read -- polystyrene --.

Column 7, line 5, delete "32", second occurrence, and insert -- 33 --.

Column 9, line 38, "compelementary" should read -- complementary --.

Column 10, line 45, "frst" should read -- first --.

Column 10, line 55, after "said" insert -- base --.

Signed and Sealed this

*Twenty-sixth* Day of *August 1986*

[SEAL]

*Attest:*

DONALD J. QUIGG

*Attesting Officer*

*Commissioner of Patents and Trademarks*